US011952842B2

(12) United States Patent
Eggers et al.

(10) Patent No.: US 11,952,842 B2
(45) Date of Patent: Apr. 9, 2024

(54) SOPHISTICATED CONTOUR FOR DOWNHOLE TOOLS

(71) Applicant: BAKER HUGHES INCORPORATED, Houston, TX (US)

(72) Inventors: Heiko Eggers, Dorfmark (DE); Henning Melles, Celle (DE)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 15/604,124

(22) Filed: May 24, 2017

(65) Prior Publication Data

US 2018/0340377 A1 Nov. 29, 2018

(51) Int. Cl.
*E21B 17/046* (2006.01)
*E21B 7/20* (2006.01)

(52) U.S. Cl.
CPC ..... *E21B 17/046* (2013.01); *E21B 7/20* (2013.01)

(58) Field of Classification Search
CPC ..... E21B 23/006; E21B 43/10; E21B 23/01; E21B 17/046; E21B 7/20
See application file for complete search history.

(56) References Cited

U.S. PATENT DOCUMENTS 3,598,183 A * 8/1971 Scott ..... E21B 23/006 166/147
5,579,829 A 12/1996 Comeau et al.
5,785,357 A 7/1998 Foster et al.
5,950,744 A 9/1999 Hughes
6,702,040 B1 3/2004 Sensenig
7,299,880 B2 11/2007 Logiudice et al.
7,390,032 B2 6/2008 Hughes
7,757,784 B2 7/2010 Fincher et al.
7,845,431 B2 12/2010 Eriksen et al.
7,975,771 B2 7/2011 Ford
8,596,386 B2 12/2013 Hopkins et al.
9,556,680 B2 * 1/2017 Dirksen ..... E21B 43/10
(Continued)

OTHER PUBLICATIONS

"Bottomhole assembly" definition from Collins dictionary https://www.collinsdictionary.com/dictionary/english/bottomhole-assembly ( Year: 2020).*

(Continued)

*Primary Examiner* — Theodore N Yao
(74) *Attorney, Agent, or Firm* — Crowe & Dunlevy, P.C.

(57) ABSTRACT

A well tool includes a first component, a second component having a passage for receiving the first component, and an anchor assembly. The anchor assembly includes at least one anchor positioned on the first component that is received by at least one profile formed on an inner surface defining the passage of the second component. Either or both of the at least one profile and the at least one anchor include a ramp section that has a ramp contour defined by a ramp tangent. The ramp tangent forms an acute angle with a longitudinal axis of the borehole. A related method includes the steps of forming at least one profile in the second component, the at least one profile including a ramped section; disposing at least one anchor in the first component; and lowering the first component relative to the second component until the first anchor and the first profile align the first component and the second component in a predetermined relative alignment.

19 Claims, 7 Drawing Sheets

(56) References Cited

U.S. PATENT DOCUMENTS

| | | | | |
|---|---|---|---|---|
| 10,138,683 | B2 | 11/2018 | Strachan et al. | |
| 10,711,527 | B2 | 7/2020 | Lange et al. | |
| 2004/0149452 | A1* | 8/2004 | Pendleton | E21B 23/02 166/381 |
| 2004/0216892 | A1* | 11/2004 | Giroux | E21B 17/046 166/242.6 |
| 2005/0150690 | A1 | 7/2005 | Moriarty et al. | |
| 2005/0274547 | A1* | 12/2005 | Fincher | E21B 7/20 175/57 |
| 2007/0205022 | A1 | 9/2007 | Treviranus et al. | |
| 2009/0101345 | A1* | 4/2009 | Moffitt | E21B 7/20 166/285 |
| 2009/0288840 | A1 | 11/2009 | Eriksen et al. | |
| 2014/0054036 | A1* | 2/2014 | Regener | E21B 33/14 166/285 |
| 2014/0216176 | A1 | 8/2014 | Kimour | |
| 2015/0176341 | A1* | 6/2015 | Hughes | E21B 17/042 166/242.6 |
| 2015/0204144 | A1* | 7/2015 | Mullins | E21B 43/10 166/285 |
| 2015/0226024 | A1* | 8/2015 | Travis | E21B 33/085 166/360 |
| 2016/0251945 | A1* | 9/2016 | Noffke | E21B 17/046 166/377 |
| 2018/0087335 | A1* | 3/2018 | Weckend | E21B 23/01 |
| 2018/0156000 | A1* | 6/2018 | Cleven | E21B 23/02 |
| 2019/0024474 | A1* | 1/2019 | Chau | E21B 33/085 |

OTHER PUBLICATIONS

"Disintegrate" definition from Merriam Webster https://www.merriam-webster.com/dictionary/disintegrate (Year: 2020).*
https://www.merriam-webster.com/dictionary/align, definition of "align" (Year: 2022).*

* cited by examiner

SOPHISTICATED CONTOUR FOR DOWNHOLE TOOLS

BACKGROUND OF THE DISCLOSURE

1. Field of the Disclosure

This disclosure relates generally to oilfield downhole tools and more particularly to contours and related methods for selectively connecting well tools.

2. Description of the Related Art

To obtain hydrocarbons such as oil and gas, boreholes are drilled by rotating a drill bit attached to the bottom of a BHA (also referred to herein as a "Bottom Hole Assembly" or ("BHA"). The BHA is attached to the bottom of a tubing, which is usually either a jointed rigid pipe or a relatively flexible spoolable tubing commonly referred to in the art as "coiled tubing." The string comprising the tubing and the BHA is usually referred to as the "drill string." In some situations, tubulars like tools or sections of a drill string or BHA may need to be connected or disconnected in the borehole and/or at the surface. The connection may be a radial connection between an inner and an outer tubular as opposed to an axial connection. Also, the connection or disconnection may be before the BHA is retrieved to the surface (i.e., run uphole). The present disclosure addresses the need to efficiently and reliably connect and/or disconnect drilling tools, as well as other well tools, in a downhole location and/or at a surface location.

SUMMARY OF THE DISCLOSURE

In aspects, the present disclosure provides a well tool that includes a first component, a second component having a passage for receiving the first component, and an anchor assembly. The anchor assembly includes at least one anchor positioned on the first component, and at least one profile formed on an inner surface defining the passage of the second component and configured to receive the at least one anchor. Either or both of the at least one profile and the at least one anchor may include a ramp section. The ramp section may have a ramp contour defined by a ramp tangent. The ramp tangent may form an acute angle with a longitudinal axis of the borehole, the acute angle being larger than 1 degree and smaller than 90 degrees.

In aspects, the present disclosure also provides a related method that includes the steps of forming at least one profile in the second component, the at least one profile including a ramped section; disposing at least one anchor in the first component; and lowering the first component relative to the second component until the first anchor and the first profile align the first component and the second component in a predetermined relative alignment.

Illustrative examples of some features of the disclosure thus have been summarized rather broadly in order that the detailed description thereof that follows may be better understood, and in order that the contributions to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

The present invention relates to an apparatus and methods for selectively connecting and/or disconnecting well components while at the surface or downhole. In some arrangements, the components may be concentrically arranged with an inner component disposed inside a bore or passage of an outer component. In other arrangements, the alignment may be eccentric or only partially overlapping As used herein, a "component" may be a downhole tool, a drill string, a bottomhole assembly (BHA), casing, liner, packer, or any other tool, instrument, equipment, or structure used while drilling, completing, or otherwise constructing, servicing, or operating a well.

Embodiments of the present disclosure may include anchors that are self-aligning in the borehole. That is, as personnel bring the two components into mating engagement, one or both of the components rotate or move relative to one another to allow the anchors to properly orient and engage. The orientation, or alignment, may have a circumferential, radial, and/or axial component. This process may be done automatically or controlled by personnel. The features that enable the self-alignment are referred to as "contours" or "ramps," and are discussed in further detail below.

The teachings of the present disclosure may be advantageously applied to a variety of well tools and systems. One non-limiting application for anchors according to the present disclosure is liner drilling. Liner drilling may be useful for drilling a borehole in underground formations with at least one formation that has a significantly different formation pressure than an adjacent formation or where time dependent unstable formations do not allow sufficient time to case off the hole in a subsequent run.

Figure 1:
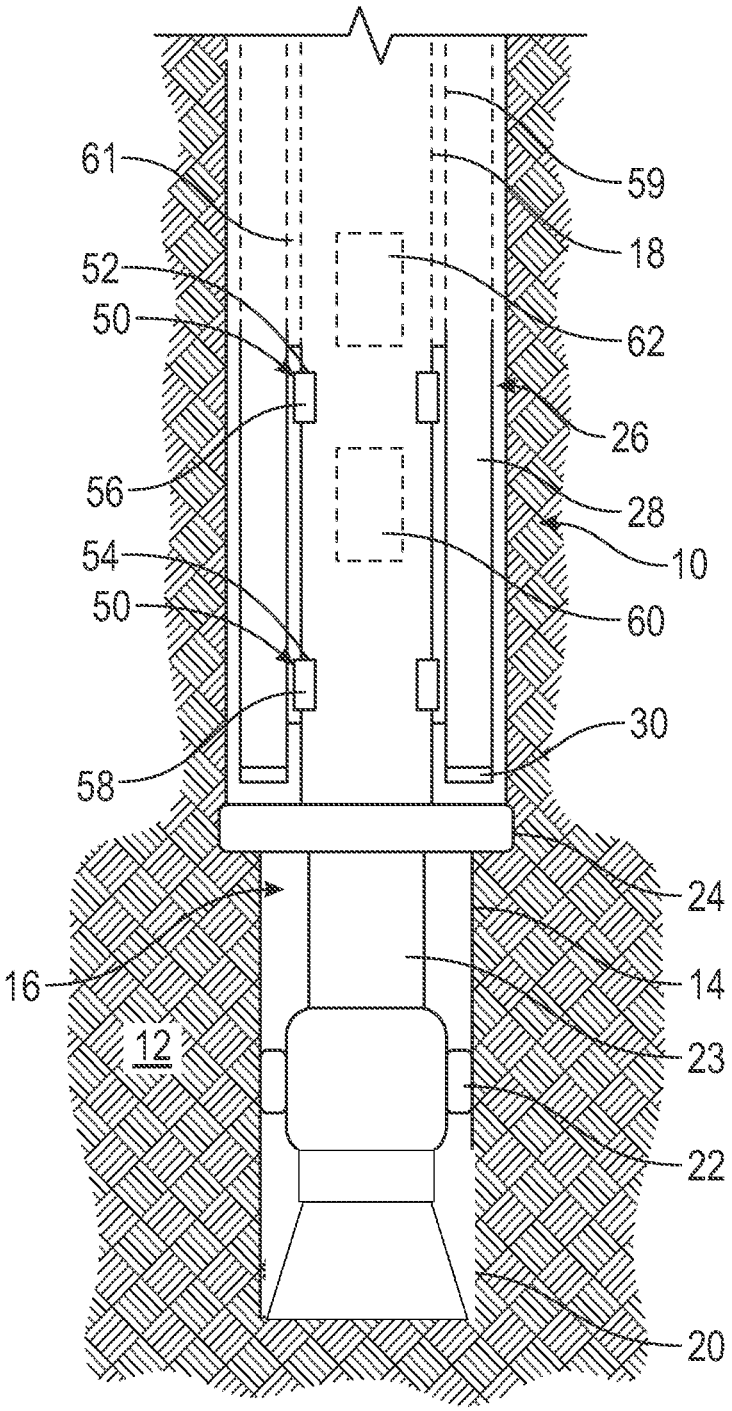
FIG. 1 shows a schematic diagram of a well construction system with a bottomhole assembly utilizing an anchor assembly of the present disclosure.

In FIG. 1, there is shown an embodiment of a liner drilling system 10 that may use anchoring devices according to the present disclosure. The teachings of the present disclosure may be utilized in land, offshore or subsea applications. In FIG. 1, a laminated earth formation 12 is intersected by a borehole 14. A BHA 16 is conveyed via a drill string 18 into the borehole 14. The drill string 18 may be jointed drill pipe or coiled tubing, which may include embedded conductors for power and/or data for providing signal and/or power communication between the surface and downhole equipment. The BHA 16 may include a drill bit 20 for forming the borehole 14. The BHA 16 may also include a steering unit 22 and a drilling motor 23. Other tools and devices that may be included in the BHA 10 include steering units, MWD/LWD tools that evaluate a borehole and/or surrounding formation, stabilizers, downhole blowout preventers, circulation subs, mud pulse instruments, mud turbines, etc. When configured as a liner drilling assembly to perform liner drilling, the BHA 16 utilizes a reamer 24 and a liner assembly 26. The liner assembly 26 may include a wellbore tubular 28 and a liner bit 30.

An anchor assembly 50 may be used to selectively connect the liner assembly 26 with the drill string 18. In one embodiment, the anchor assembly 50 may include a torque anchor 52 and a weight anchor 54 that selectively engage with a torque profile 56 and a weight profile 58, respectively. By selectively, it is meant that the anchor assembly 50 may be remotely activated and/or deactivated multiple times using one or more control signals and while the anchor assembly 50 is in the borehole 14 or at the surface. While the torque anchor 52 is shown uphole of the weight anchor 54, their relative positions may also be reversed.

The anchors 52, 54 are positioned on the drill string 18 and may be members such as ribs, teeth, rods, or pads that can be shifted between a retracted and a radially extended position using an actuator 60. In some embodiments, the anchors 52, 54 may be fixed in the radially extended position. The actuator 60 may be electrically, electro-mechanically, or hydraulically energized. As shown, the anchors 52, 54 may share a common actuator or each anchor 52, 54 may have a dedicated actuator. The actuators may have a communication module 62 configured to receive control signals for operating the anchor assembly 50 and to transmit signals to the surface (e.g., signals indicating the operating state or condition of the anchor assembly 50).

Figure 2:
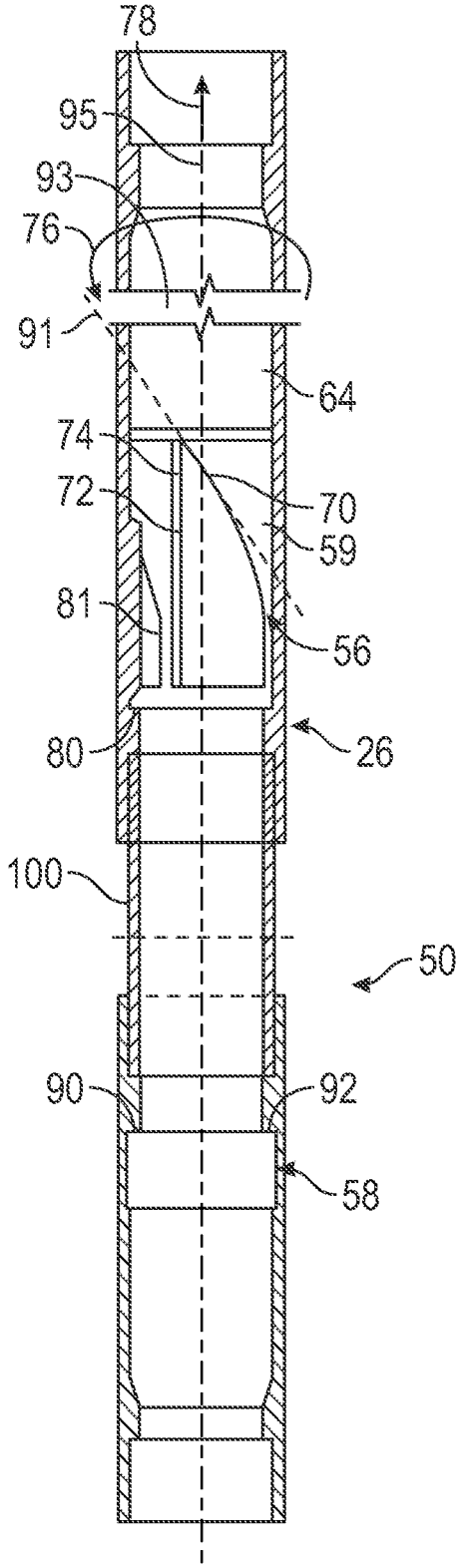
FIG. 2 shows a sectional view of profiles for an anchor in accordance with the present disclosure.

Referring now to FIG. 2, there is shown in a sectional view the profiles 56, 58 with which the anchors 52, 54 (FIG. 1) engage. The profiles 56, 58 may be formed on an inner surface 59 that defines a passage 61 of the liner assembly 26.

In one embodiment, the profile 56 may be a recessed area formed in the inner surface 59 of the liner assembly 26 and that is shaped to allow the extension of the anchors 52 into the recessed area 61 in any circumferential orientation of the inner and outer component and to self-align the liner assembly 26 with the drill string 18 (FIG. 1). For instance, the ramp section 70 may protrude from the inner surface 59 and define a ramp surface that guides the anchor 52 to a predetermined alignment with a second component. The profile 56 may include a curved ramp section 70 and an axially aligned spline 72 (or load flank) that join at a juncture 74. The spline 72 may be considered an axially aligned shoulder. The profile 56 may also include a circumferential groove 80 that is chamfered at the lower terminal end of the ramp section 70. The curvature and surface defining the ramp section 70 are selected to present a helix-like structure against which the anchor 52 (FIG. 1) can slide toward the groove 80 in a manner that allows/causes the drill string 18 to rotate. In some arrangements, a ramp section, similar to ramp section 70, can be formed on the anchor 52.

In one non-limiting embodiment, a ramp tangent 91 forms an acute angle 91 with a longitudinal axis 95 of the anchor assembly 50. The acute angle 91 may be between 1 degree and 90, between 1 degree and 70 degrees, or between 1 degree and less than 70 degrees. For surfaces that do not have a curvature, the ramp tangent may be the slope of the straight line defining the surface. The spline 72, which is parallel with the longitudinal axis (or axis of symmetry), prevents further rotation in the direction the drill string 18 rotates while sliding along the splines 72 and moves toward the groove 80. This rotational direction is shown with arrow 76. Thus, torque transfer between the drill string 18 and the liner assembly 26 occurs at the spline 72 when the drill string is rotated in the direction shown by arrow 76. It should be noted that torque transfer in the opposite rotational direction can occur when the anchor 52 is positioned between the parallel shoulders 81 and 72 next to the groove 80. Axial loading from the drill string 18 to the liner assembly 26 occurs when the drill string 16 is axially displaced in the direction shown with arrow 78. Downward axial movement is stopped when the anchor 52 contacts the surfaces of the circumferential groove 80. The groove 80 may be partially or completely circumferential.

The sidewalls of the region 56 with the ramp 70 and the spline 72 and the groove 80 may have a stress optimized shape, that allows to transfer the loads axially and torsional and to withstand a predefined differential pressure during the later following cementing procedure or other applications. In one embodiment, the profile 58 may be a recessed area in an inner wall of the liner assembly 26 that is shaped as a circumferential groove with an endstop shoulder 90. The groove 90 may include a stress reducing multi-center point arc contour 92.

Figure 3A:
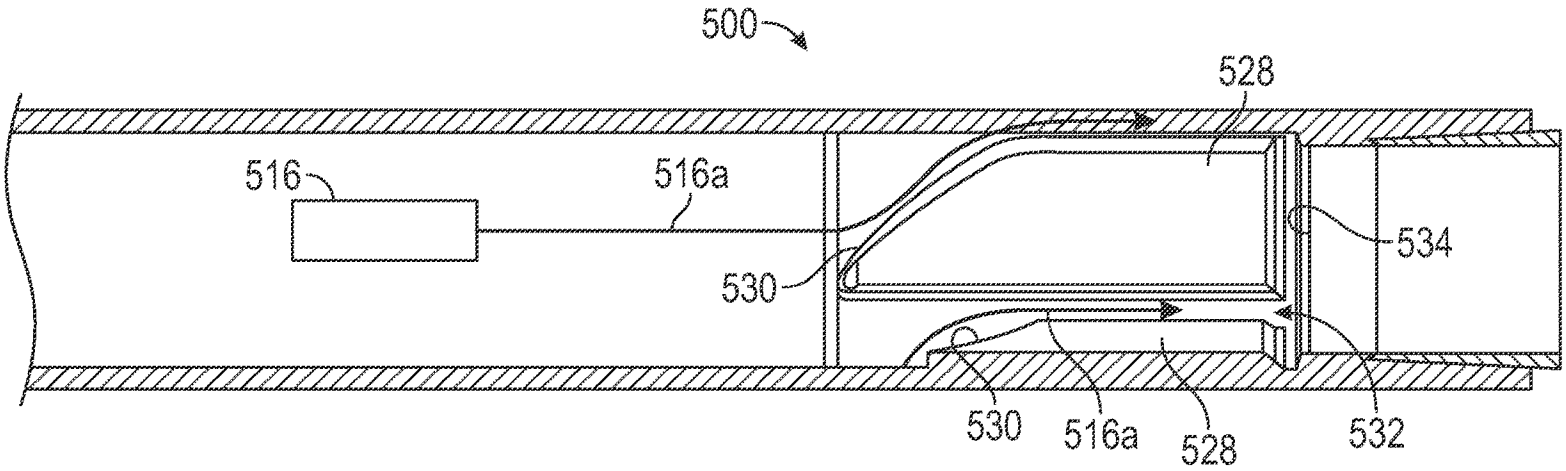
FIGS. 3A and 3B sectionally and isometrically illustrate an embodiment of contours in accordance with the present disclosure.
Figure 3B:
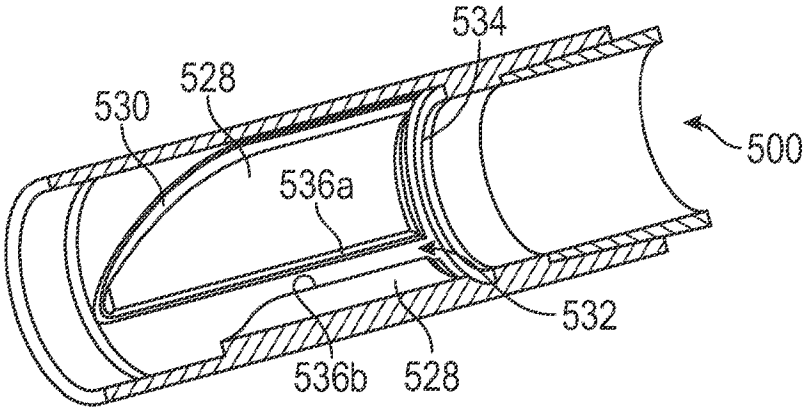

Referring to FIGS. 3A-B, there is shown a section of a downhole tool 500 wherein shoulders 528 are formed. The shoulders 528 are separated by cavities 532, one of which is shown. An anchor 516, when moving in an axial direction, contacts and slides along a surface 530 that projects radially inward from a wall of the downhole tool 500. The surface 530 may be considered a "ramp." The axial direction may be the uphole or downhole direction. The surface 530 forces the anchor 516 to move along a pre-defined path as shown by line 516*a*. A wall 534 of a groove, which may be partially or completely circumferential, blocks further movement of the anchor 516 in the axial direction. Further, opposing surfaces 536*a* and 536*b* form side walls on which torque may be transmitted.

The contours or ramps of the present disclosure are susceptible to numerous variations. In some embodiments, one or more surfaces defining the ramp (or contour) may be non-linear. The non-linear surfaces may be defined by a radius, a mathematic relationship (e.g., a polynomial), or an arbitrary curvature. In some embodiments, one or more of the surfaces defining the ramp, may use straight lines. In some embodiments, the ramp may use a composite geometry using different types of non-linear surface and/or linear surfaces. For instances, the linear surfaces may use different slopes. Thus, the ramp contour may be defined by one or more curves, straight lines, different curves, straight lines having different slopes, and combinations of curves and straight lines.

Figure 4A:
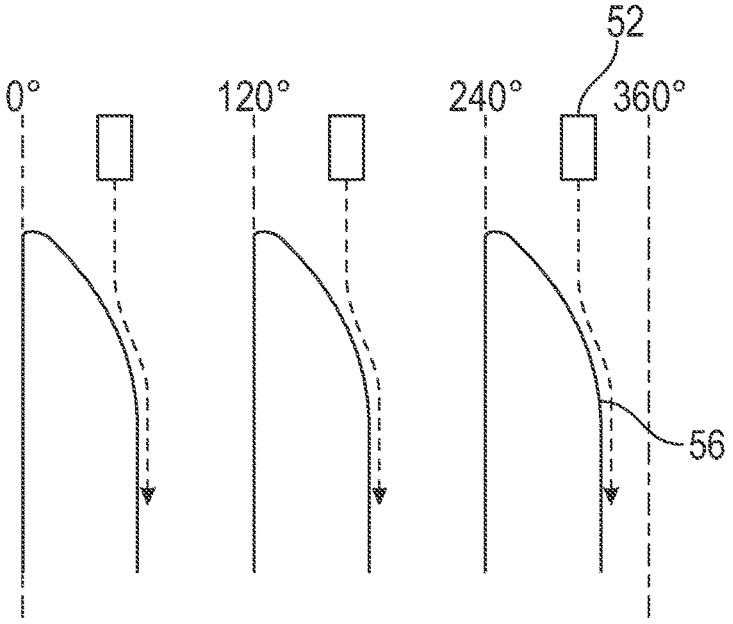
FIG. 4A shows an unfolded view of a section of a well tool where contours and anchors mate and align.
Figure 4B:
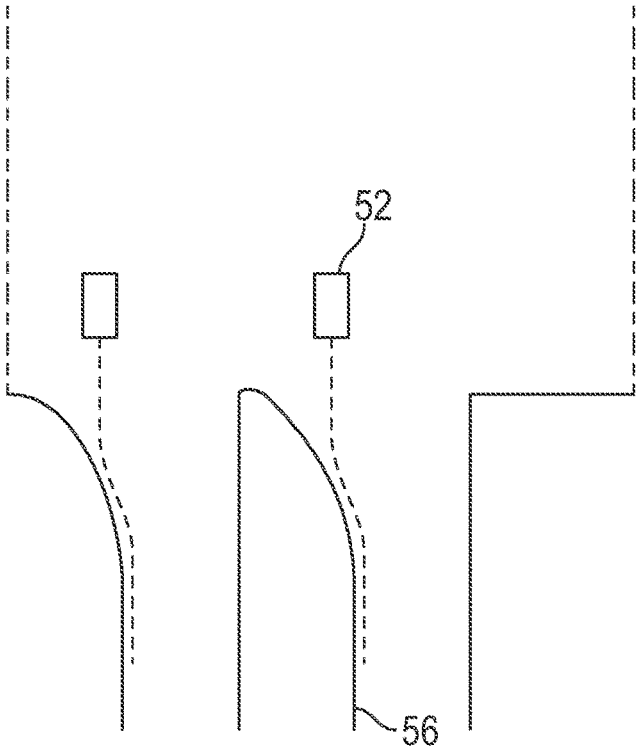
FIG. 4B shows an unfolded view of a section of a well tool where contours and anchors are configured to mate only in a coded position.

FIGS. 4A-B illustrate various configurations of anchors 52 and contours 56 according to the present disclosure. FIG.

4A illustrates profiles in an "unwrapped" form. Anchors 52 contact and slide along surfaces of the profiles 56. While three profiles 56 are shown, it should be understood that greater or fewer may be used. In FIG. 4A, there are shown a plurality of anchors 52 and associated contours 56. Thus, some embodiments may have one anchor and one contour and other embodiments may have more than one anchor and associated contour. FIG. 4B illustrates a "keyed" or "coded" configuration for an anchors 52 and contours 56. As a non-limiting example, there are two anchors 52 and two contours 56. Thus, an anchor assembly that has three or more anchors would not be able to mate or pass through the contours 56. Thus, using a mismatch of in the number of anchors and contours is one non-limiting way to selective mate anchors and contours.

The anchors of the present disclosure may be configured to principally transmit force in one or more selected modes (e.g., rotationally, axially, torque, compression, tension, etc.). As discussed below, the profile 56, in addition to providing a self-alignment function illustrated in FIG. 4A, can transfer torque and axial loading in selected directions (e.g., in the downhole direction to push the liner assembly 26 through a high friction zone or a horizontal section) between the drill string 18 and the liner assembly 26. The profile 58 can transfer axial loadings principally in the uphole direction between the drill string 18 and the liner assembly 26.

In one embodiment, a marker tube assembly 100 may be positioned between the profile 56 and the profile 58 or any location on the liner assembly 26. The marker tube assembly 100 needs only to have a known or predetermined position relative to another location on the liner assembly 26.

Referring to FIGS. 1 and 2, in an illustrative mode of operation, the liner assembly 26 is positioned in the borehole 14. Later, the drill string 18 is lowered into the passage 61 of the liner assembly 26. Connecting the liner assembly 26 to the drill string 18 may require these two components to have a predetermined alignment, which may be a circumferential, radial and/or axial relative alignment.

The marker tube assembly 100 may be used to locate the torque profile 56. In some embodiments, the profiles 58 may act as the grooves for the marker tube assembly 100. At that time, the torque anchor 52 may be extended using a control signal sent from a surface location. Alternatively, the extension may occur during an automatic mode triggered by the marker tube downhole. In another variation, the marker itself is a predefined shaped liner contour that matches with the sliding anchor profile and allows the engagement only in this position where the inner and outer part acts as a key-lock mechanism.

Alternatively, if the anchors 52 are already extended or generally fixed, the number or circumferential position of the anchor(s) 52 can encode a certain position which can mate only to a similar counterpart as shown in FIG. 4B. That is, the anchors(s) 52 can only enter the profile(s) 56 if there is a predetermined rotational alignment.

With the torque anchor 52 extended, the drill string 18 is lowered (i.e., moved in the downhole direction) until the torque anchor 52 contacts the ramp section 70. Further lowering causes the drill string 18 to rotate until the torque anchor 52 is seated at a shoulder of the groove 80. At this point, the liner assembly 26 to the drill string 18 have the predetermined circumferential, radial and/or axial alignment. Further rotation of the drill string 18 can transmit torque to the liner assembly 26 via the physical contact between the torque anchor 52 and the spline 72. Torque may also be transmitted using the shoulder 81, depending on the rotating direction. As noted previously, this process may be done using personnel inputs or automatically.

With the drill string 18 and the liner assembly 26 now properly aligned, the weight anchors 54 can be extend since the weight profile 58 may be an entirely circumferential groove that allows the anchors 54 to be extended independently from any rotational position. Then we lift up the inner drill string 18 and the drill string 18 can be pulled in the uphole direction until the weight anchor 54 contacts the endstop shoulder 90 and physically engage the weight profile Referring still to FIGS. 1 and 2, in one exemplary mode of operation, the drill string 18 and the liner assembly 26 are tripped downhole and drilling commences. During this time, drill bit 20 forms the primary bore and the reamer 24 enlarges the primary bore. The anchor assembly 26 provides a physical engagement that allows the drills string 18 to pull or push the liner assembly 26 through the borehole 14. During this time, the torque anchor 52 principally transmits the torque necessary to rotate the liner assembly 26 and transmits a downhole-oriented force to push the liner assembly 26 downhole. The weight anchor 54 principally transmits the forces necessary to keep the liner assembly 26 locked to the drill string 18 in the uphole axial direction. More generally, the weight anchors 54 transmits forces in an axial direction, which is generally along the borehole.

From the above, it should be appreciated that what has been described includes positioning, aligning, and orientating systems/methodologies that use matching between anchor and cavities lock and key functionality by number, shape, position. These systems eliminate the need for rotatable orientation of the components being connected. Additionally, stress optimization in regards to applied load from axial forces, torsion 1 load and finally pressure rating for the differential pressure versus the remaining wall thickness. A tilted contact shoulder to optimize the transmission path of the axial weight.

It should be understood that the teachings of the present disclosure are not limited to any particular downhole application. Anchor assemblies of the present disclosure may also be used during completion, logging, workover, or production operations. In such applications, the components to be connected by a wireline, coiled tubing, production string, casing, or other suitable work string. One non-limiting application for the contours of the present disclosure relate to liner-drilling activities, which are described in greater detail below.

Figure 5:
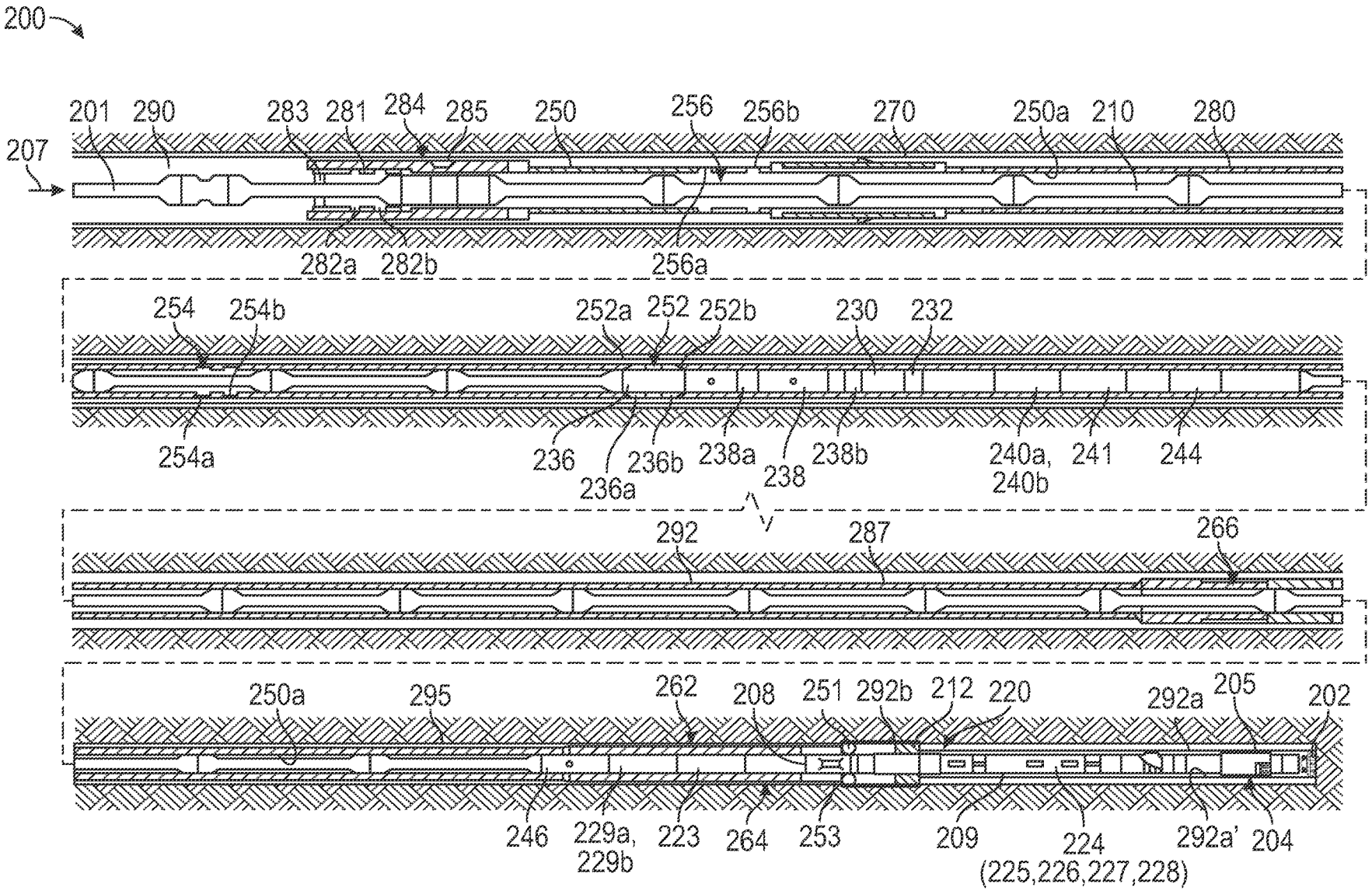
FIG. 5 is a line diagram of an exemplary drill string that includes an inner string and an outer string, wherein the inner string is connected to a first location of the outer string to drill a hole of a first size.

Turning now to FIG. 5, a schematic line diagram of an example string 200 that includes an inner string 210 disposed in an outer string 250 is shown. In this embodiment, the inner string 210 is adapted to pass through the outer string 250 and connect to the inside 250*a* of the outer string 250 at a number of spaced apart locations (also referred to herein as the "landings" or "landing locations"). The shown embodiment of the outer string 250 includes three landings, namely a lower landing 252, a middle landing 254 and an upper landing 256. The inner string 210 includes a drilling assembly or disintegrating assembly 220 (also referred to as the "bottomhole assembly") connected to a bottom end of a tubular member 201, such as a string of jointed pipes or a coiled tubing. The drilling assembly 220 includes a first disintegrating device 202 (also referred to herein as a "pilot bit") at its bottom end for drilling a borehole of a first size 292*a* (also referred to herein as a "pilot hole"). The drilling assembly 220 further includes a steering device 204 that in some embodiments may include a number of force application members 205 configured to extend from the drilling assembly 220 to apply force on a wall 292*a*' of the pilot hole 292*a* drilled by the pilot bit 202 to steer the pilot bit 202 along a selected direction, such as to drill a deviated pilot hole. The drilling assembly 220 may also include a drilling motor 208 (also referred to as a "mud motor") 208 configured to rotate the pilot bit 202 when a fluid 207 under pressure is supplied to the inner string 210.

In the configuration of FIG. 5, the drilling assembly 220 is also shown to include an under reamer 212 that can be extended from and retracted toward a body of the drilling assembly 220, as desired, to enlarge the pilot hole 292*a* to form a wellbore 292*b*, to at least the size of the outer string. In various embodiments, for example as shown, the drilling assembly 220 includes a number of sensors (collectively designated by numeral 209) for providing signals relating to a number of downhole parameters, including, but not limited to, various properties or characteristics of a formation 295 and parameters relating to the operation of the string 200. The drilling assembly 220 also includes a control circuit (also referred to as a "controller") 224 that may include circuits 225 to condition the signals from the various sensors 209, a processor 226, such as a microprocessor, a data storage device 227, such as a solid-state memory, and programs 228 accessible to the processor 226 for executing instructions contained in the programs 228. The controller 224 communicates with a surface controller (not shown) via a suitable telemetry device 229*a* that provides two-way communication between the inner string 210 and the surface controller. Furthermore, a two-way communication can be configured or installed between subcomponents of multiple parts of the BHA. The telemetry device 229*a* may utilize any suitable data communication technique, including, but not limited to, mud pulse telemetry, acoustic telemetry, electromagnetic telemetry, and wired pipe. A power generation unit 229*b* in the inner string 210 provides electrical power to the various components in the inner string 210, including the sensors 209 and other components in the drilling assembly 220. The drilling assembly 220 also may include a second or multiple power generation devices 223 capable of providing electrical power independent from the presence of the power generated using the drilling fluid 207 (e.g., third power generation device 240*b* described below).

In various embodiments, such as that shown, the inner string 210 may further include a sealing device 230 (also referred to as a "seal sub") that may include a sealing element 232, such as an expandable and retractable packer, configured to provide a fluid seal between the inner string 210 and the outer string 250 when the sealing element 232 is activated to be in an expanded state. Additionally, the inner string 210 may include a liner drive sub 236 that includes attachment elements 236*a*, 236*b* (e.g., latching elements or anchors) that may be removably connected to any of the landing locations in the outer string 250. The inner string 210 may further include a hanger activation device or sub 238 having seal members 238*a*, 238*b* configured to activate a rotatable hanger 270 in the outer string 250. The inner string 210 may include a third power generation device 240*b*, such as a turbine-driven device, operated by the fluid 207 flowing through the inner sting 210 configured to generate electric power, and a second two-way telemetry device 240*a* utilizing any suitable communication technique, including, but not limited to, mud pulse, acoustic, electromagnetic and wired pipe telemetry. The inner string 210 may further include a fourth power generation device 241, independent from the presence of a power generation source using drilling fluid 207, such as batteries. The inner string 210 may further include pup joints 244, a burst sub 246, and other components, such as, but not limited to, a release sub that releases parts of the BHA on demand or at reaching predefined load conditions.

Still referring to FIG. 5, the outer string 250 includes a liner 280 that may house or contain a second disintegrating device 251 (e.g., also referred to herein as a reamer bit) at its lower end thereof. The reamer bit 251 is configured to enlarge a leftover portion of hole 292*a* made by the pilot bit 202. In aspects, attaching the inner string at the lower landing 252 enables the inner string 210 to drill the pilot hole 292*a* and the under reamer 212 to enlarge it to the borehole of size 292 that is at least as large as the outer string 250. Attaching the inner string 210 at the middle landing 254 enables the reamer bit 251 to enlarge the section of the hole 292*a* not enlarged by the under reamer 212 (also referred to herein as the "leftover hole" or the "remaining pilot hole"). Attaching the inner string 210 at the upper landing 256, enables cementing an annulus 287 between the liner 280 and the formation 295 without pulling the inner string 210 to the surface, i.e., in a single trip of the string 200 downhole. The lower landing 252 includes a female spline 252*a* and a collet grove 252*b* for attaching to the attachment elements 236*a* and 236*b* of the liner drive sub 236. Similarly, the middle landing 254 includes a female spline 254*a* and a collet groove 254*b* and the upper landing 256 includes a female spline 256*a* and a collet groove 256*b*. Any other suitable attaching and/or latching mechanisms for connecting the inner string 210 to the outer string 250 may be utilized for the purpose of this disclosure.

The outer string 250 may further include a flow control device 262, such as a flapper valve, placed on the inside 250*a* of the outer string 250 proximate to its lower end 253. In FIG. 2, the flow control device 262 is in a deactivated or open position. In such a position, the flow control device 262 allows fluid communication between the wellbore 292 and the inside 250*a* of the outer string 250. In some embodiments, the flow control device 262 can be activated (i.e., closed) when the pilot bit 202 is retrieved inside the outer string 250 to prevent fluid communication from the wellbore 292 to the inside 250*a* of the outer string 250. The flow control device 262 is deactivated (i.e., opened) when the pilot bit 202 is extended outside the outer string 250. In one aspect, the force application members 205 or another suitable device may be configured to activate the flow control device 262.

A reverse flow control device 266, such as a reverse flapper valve, also may be provided to prevent fluid communication from the inside of the outer string 250 to locations below the reverse flow control device 266. The outer string 250 also includes a hanger 270 that may be activated by the hanger activation sub 238 to anchor the outer string 250 to the host casing 290. The host casing 290 is deployed in the wellbore 292 prior to drilling the wellbore 292 with the string 200. In one aspect, the outer string 250 includes a sealing device 285 to provide a seal between the outer string 250 and the host casing 290. The outer string 250 further includes a receptacle 284 at its upper end that may include a protection sleeve 281 having a female spline 282*a* and a collet groove 282*b*. A debris barrier 283 may also be part of the outer string to prevent cuttings made by the pilot bit 202, the under reamer 212, and/or the reamer bit 251 from entering the space or annulus between the inner string 210 and the outer string 250.

To drill the wellbore 292, the inner string 210 is placed inside the outer string 250 and attached to the outer string 250 at the lower landing 252 by activating the attachment elements 236*a*, 236*b* of the liner drive sub 236 as shown.

This liner drive sub 236, when activated, connects the attachment element 236*a* to the female splines 252*a* and the attachment element 236*b* to the collet groove 252*b* in the lower landing 252. In this configuration, the pilot bit 202 and the under reamer 212 extend past the reamer bit 251. In operation, the drilling fluid 207 powers the drilling motor 208 that rotates the pilot bit 202 to cause it to drill the pilot hole 292*a* while the under reamer 212 enlarges the pilot hole 292*a* to the diameter of the wellbore 292. The pilot bit 202 and the under reamer 212 may also be rotated by rotating the drill string 200, in addition to rotating them by the motor 208.

In general, there are three different configurations and/or operations that are carried out with the string 200: drilling, reaming and cementing. In drilling a position the Bottom Hole Assembly (BHA) sticks out completely of the liner for enabling the full measuring and steering capability (e.g., as shown in FIG. 5). In a reaming position, only the first disintegrating device (e.g., pilot bit 202) is outside the liner to reduce the risk of stuck pipe or drill string in case of well collapse and the remainder of the BHA is housed within the outer string 250. In a cementing position the BHA is configured inside the outer string 250 a certain distance from the second disintegrating device (e.g., reamer bit 251) to ensure a proper shoe track.

As provided herein, one-trip drilling and reaming operations are carried out with a BHA capable of being repositioned in a liner for the drilling of the pilot hole and the subsequent reaming. In some embodiments, fully circular magnetic rings in the liner and/or the running tool provide surface information as to a position of a running tool with respect to the liner when reconnecting to the liner. Further, position sensors can confirm alignment to various recesses in the liner for attachment. Axial loads can be transmitted through the liner at spaced locations separate from torsional loads with the attachment elements (e.g., blade arrays, anchors, etc.) spaced out on the running tool. In some embodiments, an emergency release can retract the blades from the opposing recesses to allow the running tool to be removed while opening the tool for flow. Proximity sensors in conjunction with the electromagnetic field sensed by the running tool allows alignment between the blades and the liner recesses. Blades are link driven with the link having offset centers to reduce stress.

The running tool provides the connection between the inner string and the liner during steerable liner drilling. This connection, in accordance with embodiments of the present disclosure, can be infinitely engaged and released via downlinks. In some embodiments, the connection can also be established at different positions within the liner, depending on the operation that is being performed. The connection, as provided in accordance with various embodiments of the present disclosure, can be realized by the use of engagement modules (including, e.g., in one non-limiting embodiment, blade-shaped anchors) that are designed to transmit rotational forces from an over ground turning device (e.g., top drive) to the liner. The blade-shaped anchors can support both axial forces (e.g., liner weight or pushing forces acting on the liner to overcome, for example, high friction zones, etc.) and the rotational reaction forces due to the liner/formation interaction. The liner, in accordance with various embodiments, can include inner contours in order to host or receive the anchors. In summary, a downlink activated connection/transmission (e.g., the anchors) is optimized to handle or manage high loads.

Running tools as provided herein enable systems that combine drilling, reaming, liner setting, and cementing processes into a single run. The processes of setting a liner and cementing during a single trip demands for a frequent liner-drill/cementing-string connect/disconnect procedure. Running tools as provided herein can accomplish such operation through incorporation of a set of limitless extendable and retractable anchors that support and transmit axial forces (e.g., liner weight or pushing forces acting on the liner to overcome, for example, high friction zones, etc.) and torque. In some embodiments, torque anchors configured to transmit torque and/or apply pushing forces to the liner are physically or spatially separated from weight anchors configured to support the liner weight. The liner is configured with associated inner contours in order to house or receive the anchors. The number of anchors located on or at each module (e.g., torque anchor module, weight anchor module) can be different. Such difference in number(s), shape, size, latching and/or contact faces, etc. can be provided to insure proper latching and to avoid misfits.

Running tools as provided herein can be used for running cycles. One non-limiting running cycle is as follows. In order to start a new operation (such as rathole reaming or cementing) the running tool disengages. Such disengagement can be, for example, initiated or caused by a downlink and instructions or commands transmitted from the surface, triggered by internal tool sub routines, or started by gathering downhole information that reaches pre-selected thresholds. The running tool is moved to and confirms a new position within the liner. In some embodiments, the location of the running tool can be detected by a position detection system. The position detection system includes a marker and a position sensor. By way of a non-limiting example, the position may be measured by a magnetic marker/Hall sensor combination, gamma marker/detector, liner contour/acoustic sensor, or other marker/detector combination, as known in the art. At the new location, the running tool re-engages to the liner. The engagement can be caused by a downlink, triggered by internal tool sub routines, or started by gathering downhole information that reaches pre-selected thresholds. The above noted inner contours on the liner can be used for self-alignment of the running tool by engagement with the anchors. The movement and engagement amount of the anchors can be monitored, confirmed, and measured by an LVDT (linear variable differential transformer) or any inductive, capacitive, or magnetic sensor system and sent to the surface for confirmation. As such, a downhole operation can be continued with the running tool being connected to the liner at a different location than prior to movement of the running tool.

The above described position detection system may additionally include, in some embodiments, an acoustic sensor which is configured to detect an inner contour of the liner. In such configurations, identifying the location of the running tool inside the liner may be done by correlating the depth of the running tool and the inner contour of the liner.

The running tool is subject to very high forces and torques due to both its position within the drill string and the presence of the liner. By way of non-limiting example, the transmission of the torque and the axial forces from the inner string to the liner are separated in order to handle those high loads (e.g., separate torque-anchor and weight-anchor modules with separate associated anchors). In some embodiments, a complex geometry supports the weight/torque transmission. In some embodiments, the anchors are extended (or deployed) by default such that the liner cannot be lost downhole during a power/communication loss. In some non-limiting embodiments, the extending or deploying force applied to the anchors can be provided by coil springs.

If power/communication cannot be re-established and the drill string is to be retrieved without the liner, the anchors can be permanently retracted by the use of a drop ball. In such an embodiment, the ball can activate a purely mechanical release mechanism powered by a circulating drilling fluid to thus retract the anchors. In some embodiments, the anchors can be pulled in by pulling the anchors against a contact surface to force the anchors to collapse inward and lose engagement between the running tool and the liner. While drop balls are used in the described embodiment of the present disclosure, the term "drop ball" also includes any other suitable object, e.g., bars, darts, plugs, and the like.

Figure 6A:
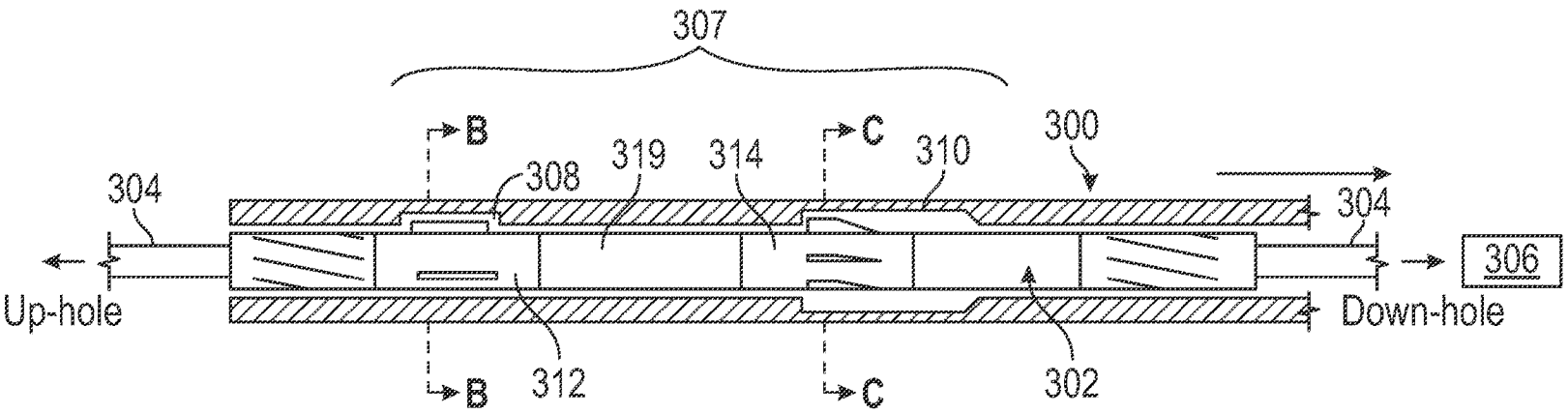
FIG. 6A is a schematic illustration of a liner and running tool in accordance with an embodiment of the present disclosure.
Figure 6C:
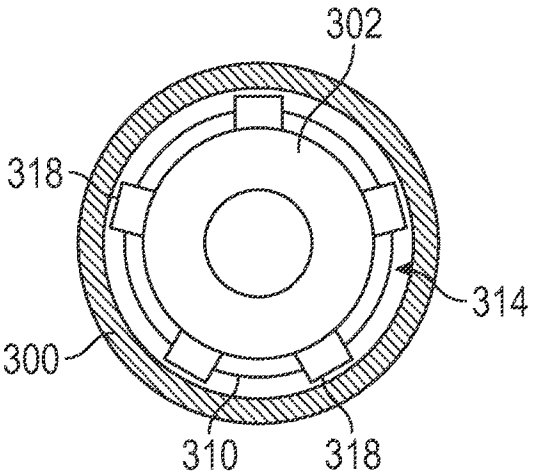
FIG. 6C is a schematic illustration of the running tool of FIG. 6A as viewed along the line C-C.
Figure 6B:
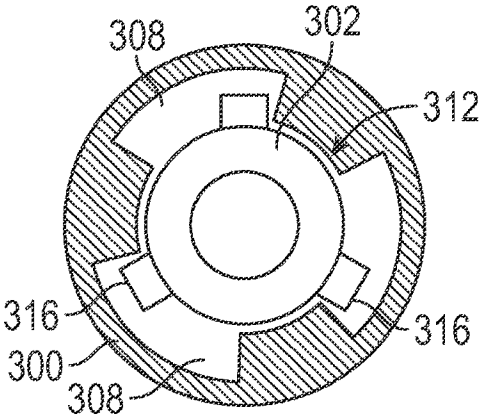
FIG. 6B is a schematic illustration of the running tool of FIG. 6A as viewed along the line B-B.

FIGS. 6A-6C illustrate various views of a liner 300 supported by a running tool 302 are shown. FIG. 6A is a side view illustration of the liner and running tool 300. FIG. 6B is a cross-sectional illustration of the liner 300 and running tool 302 as viewed along the line B-B of FIG. 6A and FIG. 6C a cross-sectional illustration of the liner 300 and running tool 302 as viewed along the line C-C of FIG. 6A.

The running tool 302 is configured on and along a string 304. The inner string 304 extends up-hole (e.g., to the left in FIG. 6A) and down-hole (e.g., to the right in FIG. 6A). Down-hole relative to the running tool 302 is a bottom hole assembly (BHA) 306. The BHA 306 can be configured and include components as described above.

To enable interaction between the liner 300 and the running tool 302, as provided in accordance with some embodiments of the present disclosure, the liner 300 includes one or more running tool engagement sections 307. As shown, the running tool engagement section 307 includes a first liner anchor cavity 308 and a second liner anchor cavity 310 that are defined as recesses or cavities formed on an interior surface of the liner 300. The liner anchor cavities 308, 310 can be axially spaced along a length of the liner 300 and/or they can be spaced in an appropriate spacing around the tool axis (e.g., equally spaced). That is, the liner anchor cavities 308, 310 are located at different positions along the length of the liner 300. The liner anchor cavities 308, 310 are sized and shaped to receive portions of the running tool 302. The liner 300 can include multiple running tool engagement sections 307 located at different distances or positions relative to a bottom end of a bore hole, and thus can enable extension of a BHA from the end of the liner to different lengths, as described herein. The running tool engagement section 307 need not include all the liner anchor cavities 308, 310, or, in other configurations, additional cavities can be provided in and/or along the liner or elsewhere as will be appreciated by those of skill in the art.

As shown, the running tool 302 may include a first engagement module 312 and a second engagement module 314 (also referred to as anchor modules). The first and second engagement modules 312, 314 are spaced apart from each other along the length of the running tool 302. The first liner anchor cavity 308 of the liner 300 is configured to receive one or more anchors of the first anchor module 312 and the second liner anchor cavity 310 of the liner 300 is configured to receive one or more anchors of the second anchor module 314. Accordingly, the spacing of the liner anchor cavities 308, 310 along the liner 300 and the spacing of the anchor modules 312, 314 can be set to allow interaction of the respective features.

The first anchor module 312 includes one or more first anchors 316 and the second anchor module 314 includes one or more second anchors 318. The anchors 316, 318 can be spaced in an appropriate spacing around the tool axis, also referred to as circumferentially spaced, and in a longitudinal direction, also referred to as axial direction or axially spaced along the length of the liner or running tool (e.g., equally spaced or unequally spaced). As shown in FIG. 6B, by way of non-limiting example, the first anchor module 312 includes three first anchors 316. Further, as shown in FIG. 6C, the second anchor module 314 includes five second anchors 318. The anchors 316, 318 of the anchor modules 312, 314 can be configured as blades or other structures as known in the art. The anchors 316, 318 are configured to be deployable or expandable to extend outward from an exterior surface of the respective module 312, 314 and engage into a respective liner anchor cavity 308, 310. Further, the anchors 316, 318 are configured to be retractable or closable to pull into the respective module 316, 318, and thus disengage from the respective module 316, 318, which enables or allows movement of the running tool 302 relative to the liner 300. Although shown with particular example numbers of anchors in each anchor module, those of skill in the art will appreciate that any number of anchors can be configured in each of the anchor modules without departing from the scope of the present disclosure.

The engagement or anchor modules 312, 314 are actuatable or operational such that the anchors or other engagable elements or features are moveable relative to the module. For example, anchors of the engagement modules can be electrically, mechanically, hydraulically, or otherwise operated to move the anchor relative to the module (e.g., radially outward from a cylindrical body). The engagement modules may be operated by combined methods, such as electro-hydraulically or electro-mechanically. In various embodiments, such as those previously mentioned, an electronics module, electronic components, and/or electronics device(s) can be used to operate the engagement module, including, but not limited to electrically driven hydraulic pumps or motors. In the simplest configuration, the electronics device can be an electrical wire, e.g., to transmit a signal, but more sophisticated components and/or modules can be employed without departing from the scope of the present disclosure. As used herein, an electronics module may be the most sophisticated electronic configuration, with electronic components either less sophisticated and/or subparts of an electronics module and an electronic device being the most basic electronic device (e.g., an electrical wire, hydraulic pump, motor, etc.). The electronic device can be a single electrical/electronic feature of the system taken alone or may be part of an electronics component and/or part of an electronics module.

Movement of the anchors may also be axial, tangential, or circumferential relative to a cylindrical module body. Actuation or operation of the engagement modules, as used herein, can be an operation that is controlled from a surface controller or can be an operation of the anchors to engage or disengage from a surface or structure in response to a pre-selected or predetermined event or detection of pre-selected conditions or events. In some embodiments, the actuation or operation of each anchor module can be independent from the other anchor modules. In other embodiments, the actuation or operation of different anchor modules can be a dependent or predetermined sequence of actuations.

In some embodiments (depending on the module configuration) actuation can mean extension from the module into engagement with a surface that is exterior to the module (e.g., an interior surface of a liner) and/or disengagement from such surface. That is, operation/actuation can mean extension or retraction of anchors into or from engagement with a surface or structure. As noted above, in some non-limiting embodiments, the different anchors may be operated separately or collectively. The separate or collective operation can be referred to as dependent or independent operation. In the case of independent operation, for example, only a single anchor may be extended or retracted, or a particular set or number of anchors may be extended or retracted. Further, for example, a particular time-based sequence of particular or predetermined anchor extensions or retractions can be performed in order to engage or disengage with the liner.

In some embodiments, the first anchors 316 of the first module 312 can be configured to transmit torque in either direction (e.g., circumferentially) with respect to the running tool 302 or the string 304. In such a configuration, the first anchors 316 may be referred to as torque anchors and the first module 312 may be referred to as a torque anchor module. The shape of the torque anchors can allow torque transmission to the liner or liner components as well as transmitting axial forces in a downhole direction. The capability of applying axial forces in the downhole direction can be used for pushing the liner through high friction zones, to influence the set down weight of the reamer bit, to activate or to support the setting of a hanger or packer, or to activate other liner components and/or completion equipment.

The second anchors 318 of the second module 314 can be configured to transmit axial forces in an uphole direction. The capability of applying axial forces in the uphole direction can be used for carrying the liner weight and therefor to influence a set down weight of the reamer bit, to activate or to support the setting of a hanger or packer, or to activate or shear off other liner components. In such a configuration, the second anchors 318 may be referred to as weight anchors and the second module 314 may be referred to as a weight anchor module. In one non-limiting example, the second module 314 can be configured to apply set down weight to a drill bit or reamer bit and instrumentation BHA 306 for directional drilling. The string 304 continues to the surface as indicated on the left side of FIG. 6A. Those of skill in the art will appreciate that torque anchors push the liner when weight is applied and weight anchors hold the liner or pull the liner when the string is pulled.

As noted, the first anchors 316 and the second anchors 318 are selectively extendable into locations on the liner 300 (e.g., liner anchor cavities 308, 310). The liner 300 can be configured with repeated configurations of liner anchor cavities 308, 310, which can enable engagement of the running tool 302 with the liner 300 at multiple locations along the length of the liner 300. The anchors 316, 318 can latch into engagement with the liner anchor cavities 308, 310 to provide secured contact and engagement between the running tool 302 and the liner 300.

One advantage enabled by engagement of the running tool 302 at different locations along the length of the liner 300 is to have different extensions of the BHA 306 from the lower end of the liner 300 when drilling a pilot hole as opposed to reaming the pilot hole already drilled. For example, for directional drilling of a pilot hole the BHA 306 extends out more from the lower end of the liner 300 and so the running tool can be engaged at a lower (e.g., down-hole) position relative to the liner 300 than when a reamer bit is enlarging a pilot hole.

Because of the separation of the first and second modules 312, 314, the application of torque can be separated from the application of axial weight on a bit. Accordingly, stress at or on the anchors 316, 318 and/or the respective modules 312, 314 when drilling and reaming a deviated borehole can be reduced. In accordance with embodiments of the present disclosure, the anchors 316, 318 are configured to fit in respective liner anchor cavities 308, 310. Pairs of liner anchor cavities 308, 310 are located on the liner 300 at different locations with appropriate spacing relative to each other so that the anchors 316, 318 can be engaged at different locations along the liner 300 and, thus, different extensions of BHA 306 from the lower end of the liner 300 can be achieved. That is, in some embodiments, the distance between each first liner anchor cavity 308 and each second liner anchor cavity 310 of each pair of liner anchor cavities is constant. In other embodiments, the spacing may not be constant. Further, in some embodiments, the shape of a cavity along a length of a string can be different at different positions. Because the running tool 302 can be moved and located at different positions within the liner 300, and such position can be indicative of an extension of the BHA 306, it may be desirable to monitor the position of the running tool 302 within the liner 300.

In some embodiments, to enable position monitoring and/or controlled operation and/or automatic operations, the running tool 302 can include one or more electronics modules 319. The electronics module 319 can include one or more electronic components, as known in the art, to enable control of the running tool 300, such as determining the engaging and disengaging, and/or enable communication with the surface and/or with other downhole components, including, but not limited to, the BHA 306. The electronics module 319 can be part of or form a downlink that enables operation as describe herein. In other configurations, the electronics module 319 can be replaced by an electronics device, such as an electrical wire, that enables transmission of electrical signals to and/or from the running tool 302.

Figure 7A:
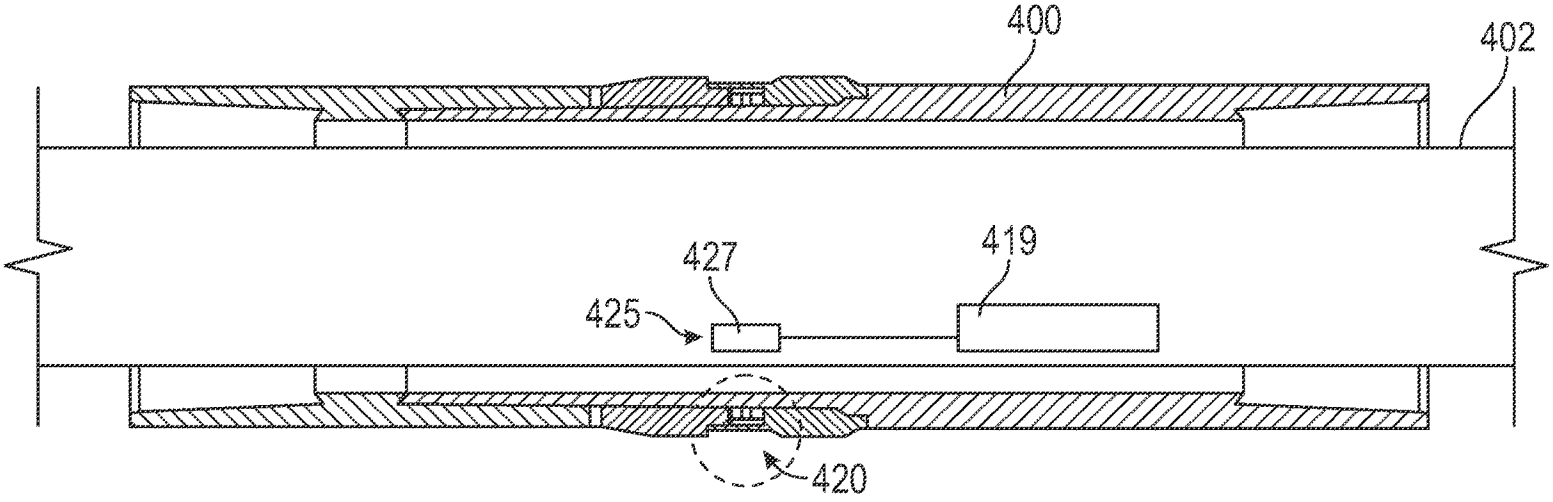
FIG. 7A is a schematic illustration of a portion of a running tool and a liner in accordance with an embodiment of the present disclosure having a position detecting system.
Figure 7B:
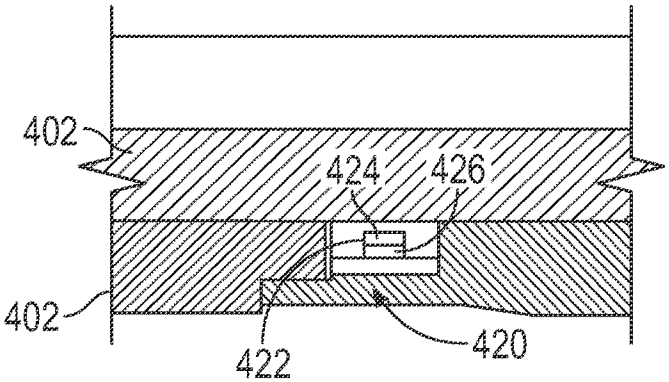
FIG. 7B is a detailed illustration of the marker of FIG. 7A.

Turning now to FIGS. 7A-7B, schematic illustrations of a liner 400 having a liner part (e.g., position marker 420) that is part of a position detection system 425 in accordance with an embodiment of the present disclosure are shown. Although shown and described in FIGS. 7A-7B with various specific components configured in and on the running tool 402 and the liner 400, those of skill in the art will appreciate that alternative configurations with the presently described components located within a liner are possible without departing from the scope of the present disclosure. In the non-limiting example, such as that shown in FIGS. 7A-7B, the liner part of the position detection system 425 is a magnetic marker.

That is, the position detection system 425 can be configured on the liners (liner 400) or running tools (running tool 402) of embodiments of the present disclosure, such as liner 300 or running tool 302 of FIG. 6A. In accordance with the embodiment of FIGS. 7A-7B, a position marker 420 is based on a magnetic ring configuration that is installed with the liner 400. However, the marker may also be located in the running tool 302. Those of skill in the art will appreciate that the position marker 420 can take any number of configurations without departing from the scope of the present disclosure. For example, magnetic markers, gamma markers, capacitive marker, conductive markers, tactile/mechanical components, etc. can be used to determine relative position between the liner and the running tool (e.g., in an axial and/or rotational manner to each other) and thus comprise one or more features of a position marker in accordance with the present disclosure. As shown, the marker is placed on the outside liner part and a sensor 427 of the detection system 425 is placed in the running tool 402. The sensor 427 is coupled to downhole electronics 419 within the running tool 402 (e.g., part of an electronics module, downlink, etc.). A sensor 427 can be a Hall sensor that detects the appearance and strength of a magnetic field. The downhole electronics 419 can be one or more electronic components that are configured in or on the running tool 402, and can be part of an electronics module (e.g., electronics module 319 of FIG. 6A). In other embodiments, an electronics device (e.g., an electrical wire) can be used instead of the downhole electronics 419.

FIG. 7A is a cross-sectional illustration of a portion of the liner 400 including the position marker 420 in accordance with an embodiment of the present disclosure. FIG. 7B is an enlarged illustration of the position marker 420 as indicated by the dashed circle in FIG. 7A.

In some embodiments, the position detection system 425 can be operably connected to or otherwise in communication with downhole electronics 419 of the running tool 402 (e.g., in some embodiments, electronics module 319 of FIG. 6A). The downhole electronics 419 of the running tool 402 can be used to communicate information to the surface, such as the position that is detected by the position detection system 425.

Properly engaging, disengaging, and moving the running tool 402 relative to the liner 400 is achieved through knowledge of the relative positions of the running tool 402 and the liner 400. By knowing the relative position of the liner 400 and the running tool 402, the anchor modules, described above, can be appropriately engaged with corresponding liner anchor cavities at different locations and thus adjustment of an extension of a BHA can be achieved. For example, the position detected by the position detection system 425 can be communicated to the surface to inform about the approximate location of the liner anchor cavity pairs relative to respective anchor modules.

In the embodiment shown in FIGS. 7A-7B, the position marker 420 includes a magnetic ring 422 that has opposed north and south poles 424, 426 as shown. In other embodiments the opposite or differing pole orientation than that shown can be used. The magnetic ring 422, in some embodiments, can be a full 360 degrees (e.g., wrap around the liner 400) or, in other embodiments, the magnetic ring 422 can be split such that less than 360 degrees is covered by the magnetic ring 422. Further, in other embodiments, the magnetic ring 422 can have overlapping ends such that the magnetic ring 422 wraps around more than 360° of the liner 400. Further still, other configurations can employ spaced magnetic buttons that form the position marker 420.

The magnetic ring 422 of the position marker 420 creates an easily detected magnetic field that can be detected and/or interact with components or features of the liner or the running tool, depending on the particular configuration. Further, advantageously, position marker 420 as shown in FIGS. 7A-7B (e.g., magnetic rings 422) can make the orientation of the running tool 402 in and relative to a liner irrelevant in detection of a signal. Accordingly, detection of the location of a liner anchor cavity can be easily achieved, e.g., by another magnetic component located on the liner. Detection can be achieved, in part, by processing carried out on an electronics module, and such detection can be communicated to the surface. Once the detection is communicated to the surface that a magnetic marker is detected, it may be desirable to position the running tool 402 with precision so that extension of the anchors of the first and/or second anchor modules engage within respective liner anchor cavities (as described above).

The foregoing description is directed to particular embodiments of the present disclosure for the purpose of illustration and explanation. It will be apparent, however, to one skilled in the art that many modifications and changes to the embodiment set forth above are possible without departing from the scope of the disclosure. It is intended that the following claims be interpreted to embrace all such modifications and changes.

What is claimed is:

1. A well tool in a well operation performed in a borehole, comprising:

a first component comprising a longitudinal axis;

a second component having a passage for receiving the first component;

a first anchor and a second anchor on the first component, the first anchor and the second anchor separated from each other along the longitudinal axis, and a first profile formed on an inner surface defining the passage of the second component and configured to receive the first anchor, wherein the first profile includes a ramp section, the ramp section having a ramp contour defined by a ramp tangent, the ramp tangent forming an acute angle with the longitudinal axis, the acute angle of the ramp tangent being larger than 1 degree and smaller than 90 degrees, the first profile further including at least two splines oriented along the longitudinal axis and a shoulder oriented perpendicular to the longitudinal axis, the at least two splines and the shoulder forming a first anchor cavity; and a second profile formed on the inner surface defining the passage of the second component and configured to receive the second anchor, the second profile forming a second anchor cavity, the second anchor cavity separated from the first anchor cavity along the longitudinal axis of the first component;

wherein the ramp section is configured to rotationally align the first anchor with the first anchor cavity, and the shoulder is configured to axially align the second anchor with the second anchor cavity along the longitudinal axis after the first anchor is rotationally aligned with the first anchor cavity, and wherein the first anchor and at least one of the at least two splines of the first anchor cavity are configured to transfer torque from the first component to the second component and the second anchor and the second anchor cavity are configured to transfer axial load from the first component to the second component.

2. The well tool of claim 1, wherein the ramp section protrudes from the inner surface of the second component.

3. The well tool of claim 1, wherein the ramp contour is defined by at least one of: (i) a curve, (ii) a straight line, (iii) a plurality of different curves, (iv) a plurality of straight lines having different slopes, and (v) a combination of at least one curve and at least one straight line.

4. The well tool of claim 1, wherein the first component comprises a first disintegrating device.

5. The well tool of claim 4, wherein the second component comprises a second disintegrating device.

6. The well tool of claim 1, wherein the first anchor includes a radially extending member that is one of: (i) fixed, and (ii) retractable, and the second anchor includes a radially extending member that is retractable.

7. The well tool of claim 1, further comprising an actuator energized using electrical energy and configured to shift the second anchor to an extended position, and wherein the actuator includes a communication module configured to receive signals from a surface location.

8. The well tool of claim 7, wherein the communication module is further configured to transmit signals to the surface location.

9. The well tool of claim 1, wherein the first component is a drill string comprising a bottom hole assembly and the second component is a liner assembly.

10. The well tool of claim 1, wherein the shoulder is configured to contact the first anchor, the first anchor applying an axial loading to the shoulder.

11. The well tool of claim 1, wherein the acute angle is smaller than 70 degrees.

12. The well tool of claim 1, wherein the first component includes a sensor and the second component includes a marker.

13. The well tool of claim 1, wherein one of the at least two splines and the ramp section join at a juncture at an uphole end of the first profile.

14. The well tool of claim 1, wherein the second anchor engage with the second anchor cavity and transfers the axial load in an uphole direction.

15. A method for performing an operation in a borehole using a well tool that has a first component and a second component, the first component comprising a longitudinal axis, the method comprising:

disposing a first anchor and a second anchor on the first component, the first anchor and the second anchor separated from each other along the longitudinal axis;

forming a first profile on an inner surface in the second component, the first profile including a ramped section, the ramped section having a ramp contour defined by a ramp tangent, the ramp tangent forming an acute angle with the longitudinal axis, the acute angle of the ramp tangent being larger than 1 degree and smaller than 90 degrees, the first profile further including at least two splines oriented along the longitudinal axis and a shoulder oriented perpendicular to the longitudinal axis, the at least two splines and the shoulder forming a first anchor cavity;

forming a second profile on the inner surface in the second component, the second profile forming a second anchor cavity configured to receive the second anchor, the second anchor cavity separated from the first anchor cavity along the longitudinal axis; and axially moving the first component relative to the second component until the first anchor and the first profile rotationally align the first anchor and the first anchor cavity and until the second anchor and the second anchor cavity axially align when the first anchor contacts the shoulder, wherein the second anchor and the second anchor cavity are axially aligned after the first anchor and the first anchor cavity are rotationally aligned; and transferring torque from the first component to the second component by using the first anchor and at least one of the at least two splines and transferring axial load from the first component to the second component by using the second anchor and the second anchor cavity.

16. The method of claim 15, further comprising contacting the shoulder with the first anchor and applying an axial loading to the shoulder.

17. The method of claim 15, further comprising shifting the second anchor into an extended position using an actuator energized using electrical energy, and wherein the actuator comprises a communication module and further comprising receiving signals from a surface location using the communication module.

18. The method of claim 15, wherein the first component comprises a first disintegrating device.

19. The method of claim 18, wherein the second component comprises a second disintegrating device.

* * * * *